US011559135B1

(12) United States Patent
Taylor

(10) Patent No.: US 11,559,135 B1
(45) Date of Patent: Jan. 24, 2023

(54) UMBRELLA SUPPORT POST WITH ROTATABLE TABLE

(71) Applicant: Mark L. Taylor, Gilbert, AZ (US)

(72) Inventor: Mark L. Taylor, Gilbert, AZ (US)

( * ) Notice: Subject to any disclaimer, the term of this patent is extended or adjusted under 35 U.S.C. 154(b) by 0 days.

(21) Appl. No.: 17/390,613

(22) Filed: Jul. 30, 2021

(51) Int. Cl.
*A47B 3/00* (2006.01)
*A47B 37/04* (2006.01)
*A45B 23/00* (2006.01)

(52) U.S. Cl.
CPC ..... *A47B 3/002* (2013.01); *A45B 23/00* (2013.01); *A47B 37/04* (2013.01); *A45B 2023/0012* (2013.01); *A45B 2200/1063* (2013.01); *A47B 2003/004* (2013.01); *A47B 2220/0008* (2013.01)

(58) Field of Classification Search
CPC ..... A47B 3/002; A47B 2003/004; A47B 13/023; A47B 13/04; A47B 2220/0008; A45B 23/00; A45B 2200/1063
See application file for complete search history.

(56) References Cited

U.S. PATENT DOCUMENTS

| | | | | | |
|---|---|---|---|---|---|
| 2,785,735 | A * | 3/1957 | Banks | A47C 9/105 | 248/435 |
| 4,461,220 | A * | 7/1984 | Wetzel | A47B 37/04 | 108/30 |
| 7,207,450 | B1 * | 4/2007 | Franklin | A47B 3/04 | 211/195 |
| 9,706,834 | B1 * | 7/2017 | Taylor | A47B 37/04 | |
| 2002/0036008 | A1 * | 3/2002 | Hickam | E04H 12/2246 | 248/188.7 |
| 2019/0335893 | A1 * | 11/2019 | Erickson | A47B 37/04 | |
| 2020/0275770 | A1 * | 9/2020 | Frankel | A47B 3/06 | |
| 2021/0401165 | A1 * | 12/2021 | Zhenni | A47B 37/04 | |
| 2022/0127872 | A1 * | 4/2022 | Chen | A47B 13/16 | |

* cited by examiner

*Primary Examiner* — Daniel J Rohrhoff
(74) *Attorney, Agent, or Firm* — Booth Udall Fuller, PLC

(57) ABSTRACT

A method of deploying a collapsible table by sliding both a top hub and a bottom hub in a first direction along the central post toward the hub stop, expanding the collapsible table into the expanded position by forcing one of the top hub and the bottom hub against a hub stop while continuing to slide the other of the top hub and the bottom hub in the first direction along the central post, sliding the adjustable stop along the central post to a first height of the plurality of selectable heights, and affixing the adjustable stop at the first height.

20 Claims, 12 Drawing Sheets

UMBRELLA SUPPORT POST WITH ROTATABLE TABLE

TECHNICAL FIELD

Aspects of this document relate generally to accessories for a beach goer, and more specifically to a portable, compact umbrella support post with a rotatable table.

BACKGROUND

Outdoor enthusiasts, such as beach goers, enjoy the advantages of various ancillary items to enhance their beach going experience, such as beach umbrellas, beach towels, pails, shovels, floatation devices, surf-riding instruments, radios, coolers, etc. One item to enhance their experience even greater is a portable, compact table, designed specifically for beach goers to place various items at an elevated position, away from the beach's sandy surface. Beach tables are a vital beach product. However, because of the numerous other items a beach goer already must trek to the beach, and the bulk and added expense of standalone beach tables, the beach goer may decide not to bring a table. Instead, beach goers will merely place their items on a towel, precariously in the sand, or rely on other items not designed for use as a "table." For example, beach goers may rely on a cooler's surface to place items away from the sand's surface, but this inhibits the ability to regularly access the cooler, i.e. everything must be removed from atop the cooler.

SUMMARY

Aspects of this document relate to a method of deploying a collapsible table, comprising providing a support post with a collapsible table in a collapsed position, the support post having: a central post, a hub stop fixedly coupled to the central post, a top hub slidably coupled to the central post, a plurality of table arms hingedly coupled to the top hub, a bottom hub slidably coupled to the central post below the top hub, a plurality of support arms each with a hub end and a support end opposite the hub end, wherein each hub end is hingedly coupled to the bottom hub and each support end is hingedly coupled to a corresponding table arm of the plurality of table arms, and an adjustable stop slidably coupled to the central post below the bottom hub, the adjustable stop configured to lock onto the central post at any of a plurality of selectable heights and define a minimum height for the bottom hub, wherein the top hub moves with respect to the bottom hub when the collapsible table expands from the collapsed position in which the top hub is distal to the bottom hub to an expanded position in which the top hub is adjacent to the bottom hub; sliding both the top hub and the bottom hub in a first direction along the central post toward the hub stop, expanding the collapsible table into the expanded position by forcing one of the top hub and the bottom hub against the hub stop while continuing to slide the other of the top hub and the bottom hub in the first direction along the central post, sliding the adjustable stop along the central post to a first height of the plurality of selectable heights, and affixing the adjustable stop at the first height.

Particular embodiments may comprise one or more of the following features. The adjustable stop may be fixedly coupled to the bottom hub. The adjustable stop may be movable along the central post independent of the bottom hub. Resting the bottom hub on top of the adjustable stop. Adjusting the minimum height for the bottom hub with the collapsible table in the expanded position by releasing the adjustable stop, sliding the adjustable stop along the central post to a second height of the plurality of selectable heights, and affixing the adjustable stop at the second height.

Aspects of this document relate to a method of deploying a collapsible table, comprising: providing a support post with the collapsible table in a collapsed position, the support post having: a central post, a hub stop fixedly coupled to the central post, a top hub slidably coupled to the central post, a plurality of table arms hingedly coupled to the top hub, a bottom hub slidably coupled to the central post below the top hub, and a plurality of support arms each with a hub end and a support end opposite the hub end, wherein each hub end is hingedly coupled to the bottom hub and each support end is hingedly coupled to a corresponding table arm of the plurality of table arms, wherein the top hub moves with respect to the bottom hub when the collapsible table expands from the collapsed position in which the top hub is distal to the bottom hub to an expanded position in which the top hub is adjacent to the bottom hub; sliding both the top hub and the bottom hub in a first direction along the central post toward the hub stop, expanding the collapsible table into the expanded position by forcing one of the top hub and the bottom hub against the hub stop while continuing to slide the other of the top hub and the bottom hub in the first direction along the central post, and with the collapsible table in the expanded position, sliding the bottom hub along the central post to a first height of a plurality of selectable heights.

Particular embodiments may comprise one or more of the following features. An adjustable stop slidably coupled to the central post below the bottom hub, the adjustable stop configured to lock onto the central post at any of the plurality of selectable heights and define a minimum height for the bottom hub. Sliding the adjustable stop along the central post to the first height and affixing the adjustable stop at the first height. The adjustable stop may be fixedly coupled to the bottom hub. The adjustable stop may be movable along the central post independent of the bottom hub. Resting the bottom hub on top of the adjustable stop. Adjusting the minimum height for the bottom hub with the collapsible table in the expanded position by releasing the adjustable stop, sliding the adjustable stop along the central post to a second height of the plurality of selectable heights, and affixing the adjustable stop at the second height.

Aspects of this document relate to a method of deploying a collapsible table, comprising: providing a support post with the collapsible table in a collapsed position, the support post having: a central post, a top hub slidably coupled to the central post, a plurality of table arms each hingedly coupled to the top hub, a bottom hub slidably coupled to the central post below the top hub, and a plurality of support arms each hingedly coupled to the bottom hub and hingedly coupled to a corresponding table arm of the plurality of table arms, wherein the top hub moves with respect to the bottom hub when the collapsible table expands from the collapsed position in which the top hub is distal to the bottom hub to an expanded position in which the top hub is adjacent to the bottom hub; expanding the collapsible table into the expanded position by limiting the movement of one of the top hub and the bottom hub while sliding the other of the top hub and the bottom hub along the central post, and with the collapsible table in the expanded position, sliding the bottom hub along the central post to a first height of a plurality of selectable heights.

Particular embodiments may comprise one or more of the following features. The support post further having a hub stop fixedly coupled to the central post. Limiting the movement of one of the top hub and the bottom hub comprises forcing one of the top hub and the bottom hub against the hub stop. Sliding both the top hub and the bottom hub in a first direction along the central post with the collapsible table in the collapsed position. An adjustable stop slidably coupled to the central post below the bottom hub, the adjustable stop configured to lock onto the central post at any of the plurality of selectable heights and define a minimum height for the bottom hub. Sliding the adjustable stop along the central post to the first height and affixing the adjustable stop at the first height. The adjustable stop may be fixedly coupled to the bottom hub. The adjustable stop may be movable along the central post independent of the bottom hub.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
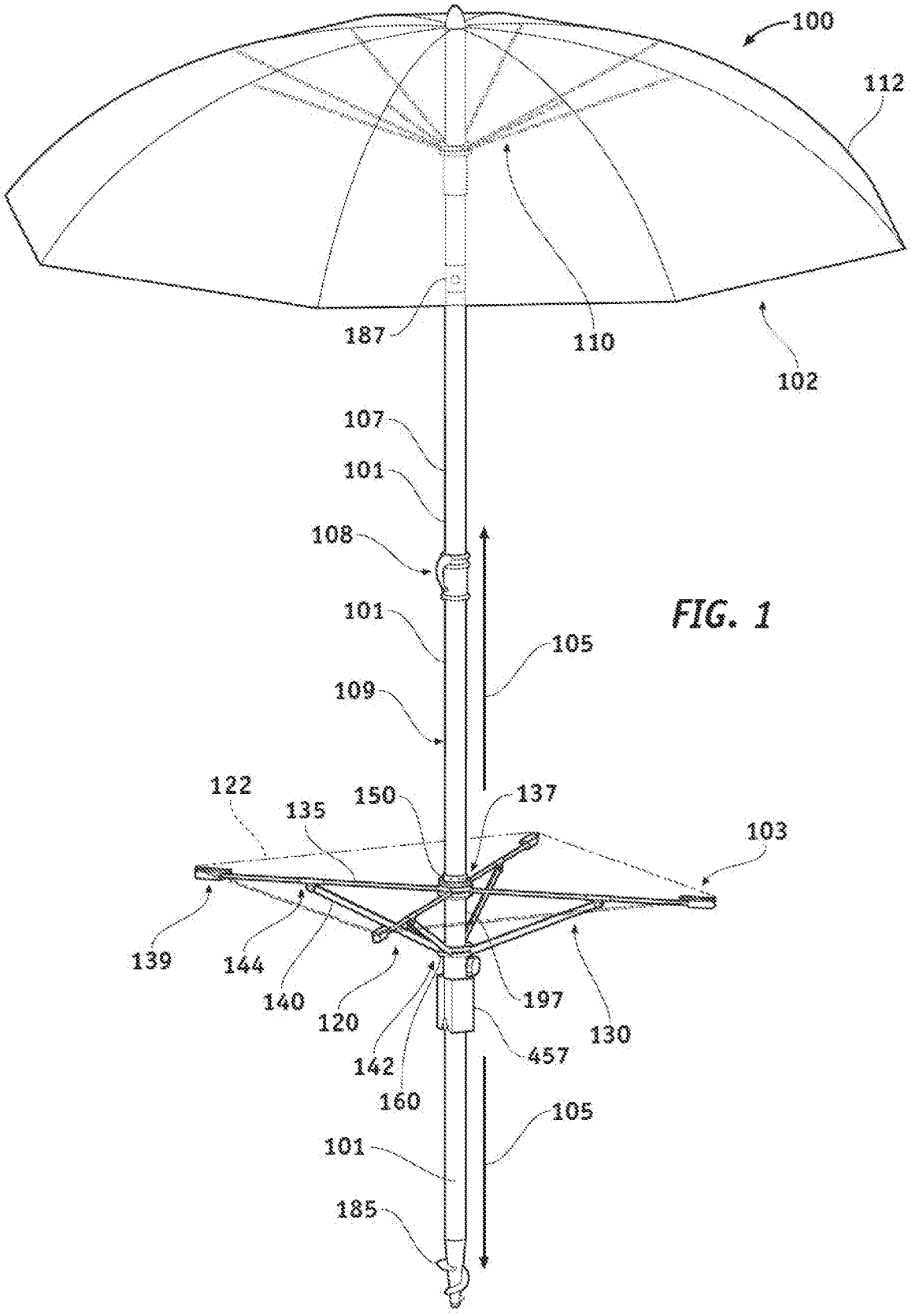
FIG. 1 is a perspective view of a support post with a collapsible table in an expanded position supporting an umbrella.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

Turning now to the figures, FIG. 1 depicts an integrated system 100 which comprises an integrated beach umbrella system 102 and a table system 103. The system 100 further comprises a support post 101. An expandable and collapsible umbrella support frame 110 and an expandable and collapsible table surface support frame 120 both engage with the support post 101. The support post 101 may comprise an upper post 107 to support the umbrella system 102 and a central post 109 to support the table system 103. The umbrella system 102 comprises an umbrella canopy 112 that couples to the umbrella support frame 110. The umbrella system 102 may also comprise a pivoting mechanism 187 as known in the art that facilitates a tilting umbrella system 102. The table system 103 comprises a collapsible table 122 that couples to a table surface support frame 120. The collapsible table 122 may comprise various regular and/or irregular geometric shapes, including a square shape, a round shape, a hexagonal shape, and a pentagonal shape. Other shapes may also be implemented. The umbrella canopy 112 and the collapsible table 122 may be formed of any material that can be coupled and/or secured to a support frame, including a natural or synthetic material.

The table surface support frame 120 may comprise a plurality of arms 130 including a plurality of table arms 135 and a plurality of support arms 140, a top hub 150, and a bottom hub 160. The top hub 150 and the bottom hub 160 may be slidably coupled to the support post 101. The plurality of table arms 135 may be hingedly coupled to the top hub 150. In addition, each of the plurality of support arms 140 may have a hub end 142 and a support end 144 opposite the hub end 142. Each hub end 142 may be hingedly coupled to the bottom hub 160 and each support end 144 may be hingedly coupled to a corresponding table arm 135 of the plurality of table arms 135. The top hub 150 and the bottom hub 160 may be slidable along the support post 101, as shown by directional arrow 105, so as to actuate the expansion of the table 122 and/or position the top hub 150 and the bottom hub 160 to accommodate various table setting heights, which thereby provides for an adjustable table height. FIG. 1 depicts umbrella system 102 and table system 103 in an expanded position, whereas, and with reference to FIG. 2, umbrella system 102 and table system 103 are shown in a collapsed position.

The term "engages" and any derivative forms of the term, as used throughout this disclosure, is meant to convey that the elements described in association with the term may be coupled, secured, affixed, moveable, slidable, and the like, such that a relationship is established between such elements and that such relationship is not limited merely by any limitation of the semantics used herein.

The support post 101 may also have a hub stop 108 fixedly coupled to the central post 109. The hub stop 108 may be located above the top hub 150 and the bottom hub 160 along the central post 109, as shown in FIG. 1. Alternatively, the hub stop 108 may be located below the top hub 150 and the bottom hub 160. In some embodiments, the support post 101 has a hub stop 108 above the top hub 150 and the bottom hub 160 and below the top hub 150 and the bottom hub 160. The hub stop 108 may define the upper and lower bounds of the range of motion of the top hub 150 and the bottom hub 160 along the central post 109. It should be understood by those skilled in the art that the hub stop 108 may be a part separate from and independent to any other apparatus connected to the support post 101 and permanently or releasably secured to the support post 101, located above and/or below the table assembly 103. As illustrated in FIG. 1, the hub stop 108 may be incorporated into another component on the support post 101, such as the umbrella pole clamp or the drive handles, by ensuring they are structurally sufficient to withstand the force of the table assembly 103 being forced against them to extend the table assembly 103. Alternatively, or additionally, an adjustable stop 458 may be used between the top hub 150 and a hub stop 108 linearly above the top hub 150, or between the bottom hub 160 and a hub stop 108 below the bottom hub 160. The adjustable hub 458 is explained in more detail elsewhere herein.

Figure 2:
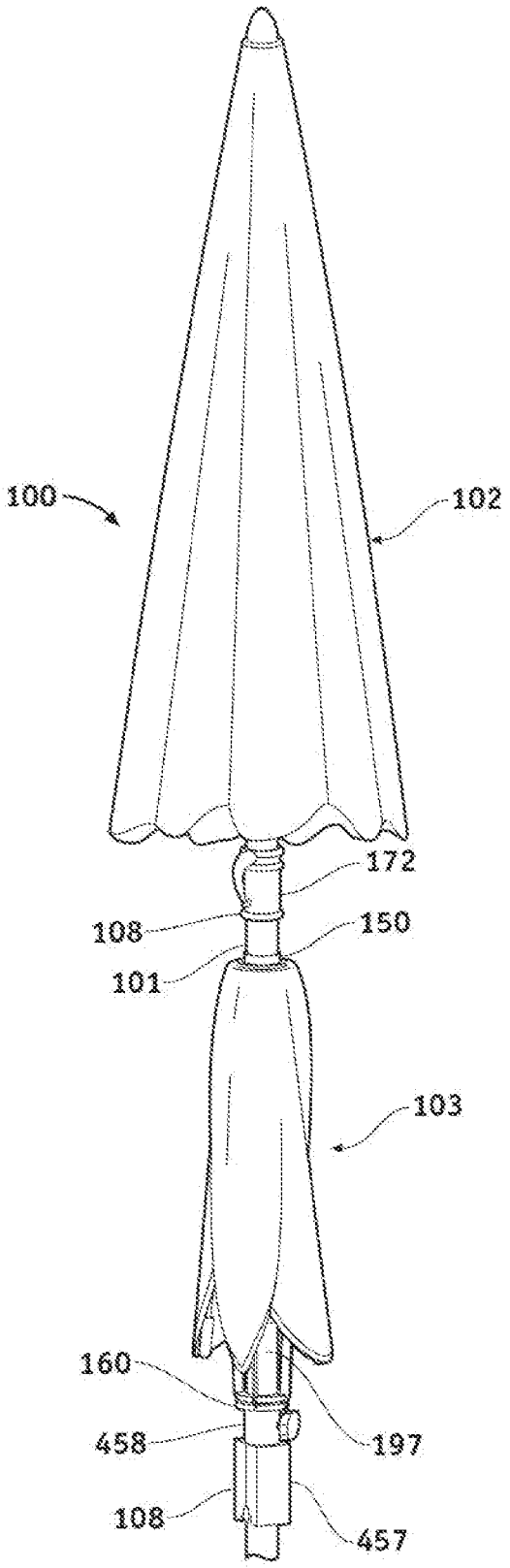
FIG. 2 is a perspective view of the support post shown in FIG. 1 with the collapsible table and umbrella in a collapsed position.
Figure 4:
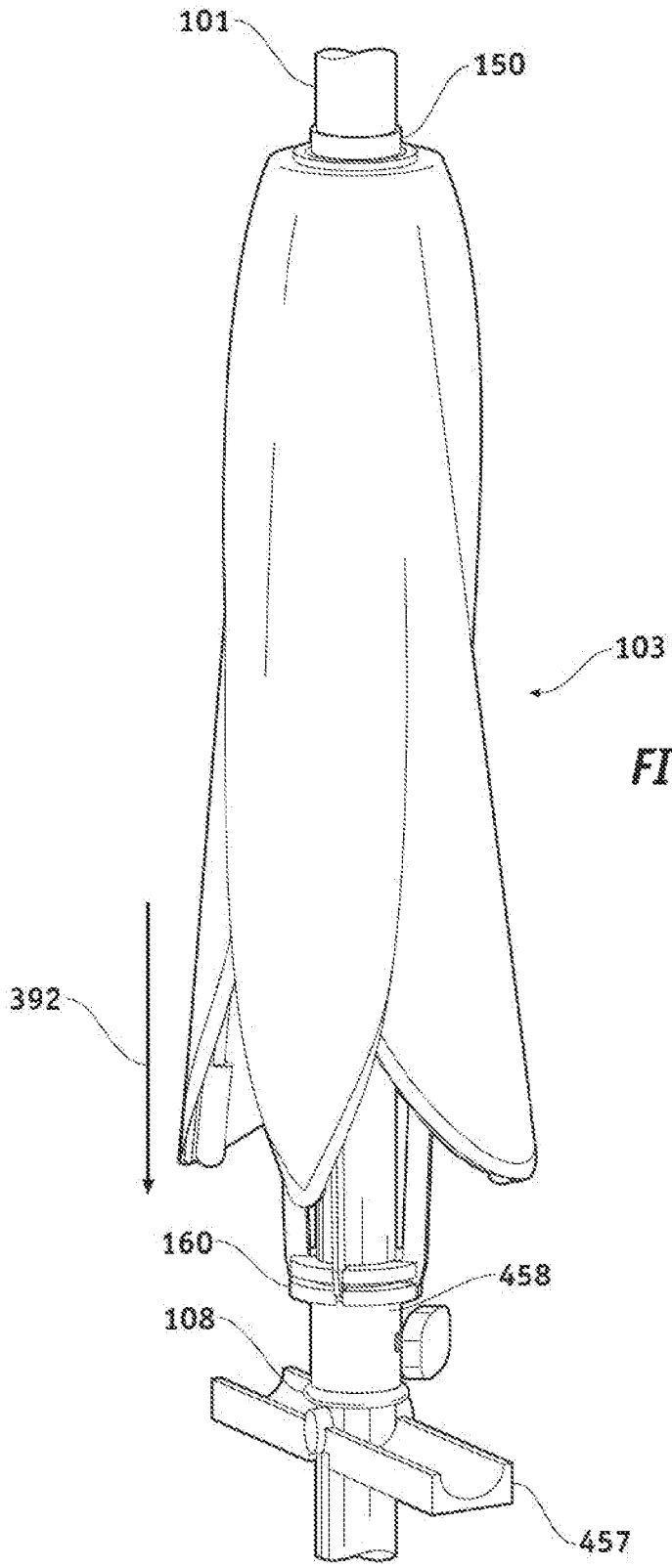
FIG. 4 is a close-up view of the collapsible table shown in FIG. 2 in the collapsed position with the bottom hub in contact with the hub stop, where the hub stop also functions as a drive handle.
Figure 5:
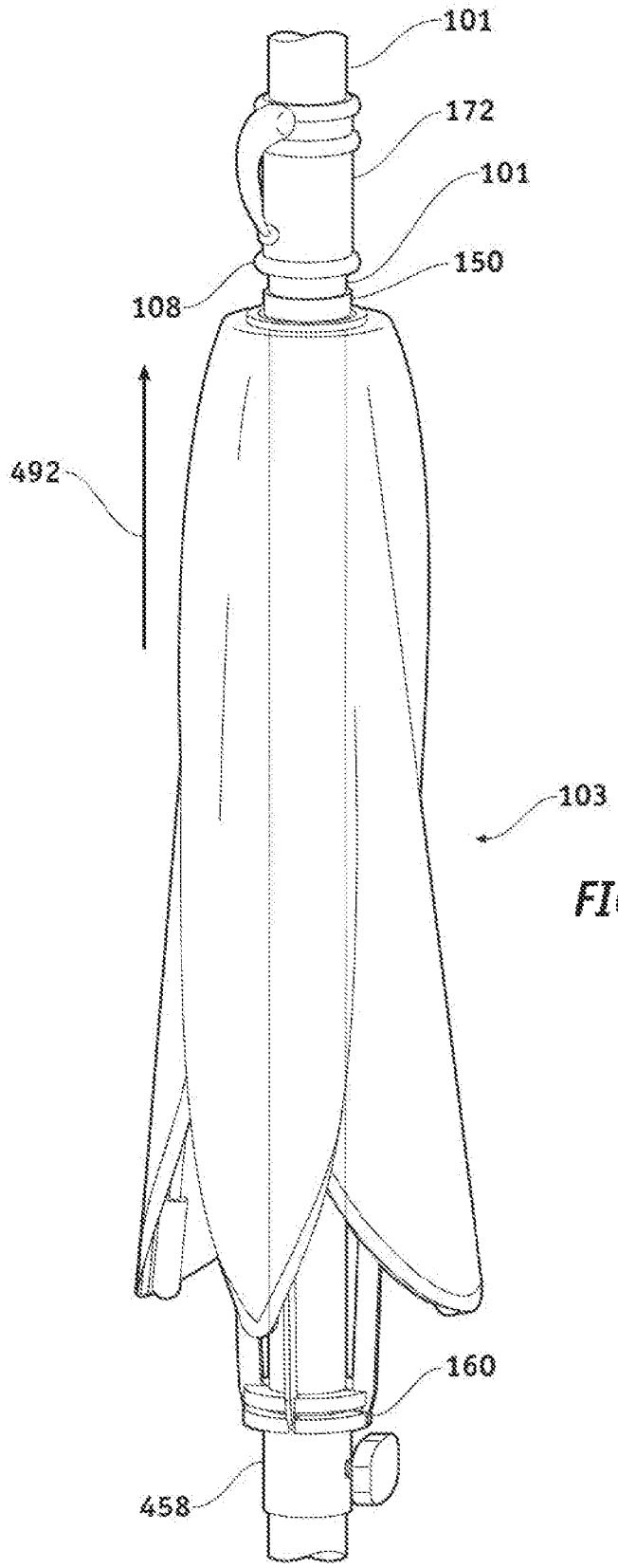
FIG. 5 is a close-up view of the collapsible table shown in FIG. 2 in the collapsed position with the top hub adjacent to the hub stop, where the hub stop is part of the pole clamp.

As shown in FIG. 2, the support post 101 additionally may have a connecting clamp assembly 172 configured to couple the upper post 107 and the central post 109 together and a drive handle 457. The drive handle 457 may be a foldable "clam-shell" handle that is deployable to provide grips to twist bottom end 185 of the support post 101 into the ground or some other surface. The bottom end 185 may have a helical thread to facilitate securing the support post 101 in a substantially upright position. In some embodiments, the connecting clamp assembly 172 and/or the drive handle 457 may also function as the hub stop 108. For example, the drive handle 457 may have an integrated hub stop 108, as shown in FIG. 4, and the connecting clamp assembly 172 may have an integrated hub stop 108, as shown in FIG. 5.

Figure 3:
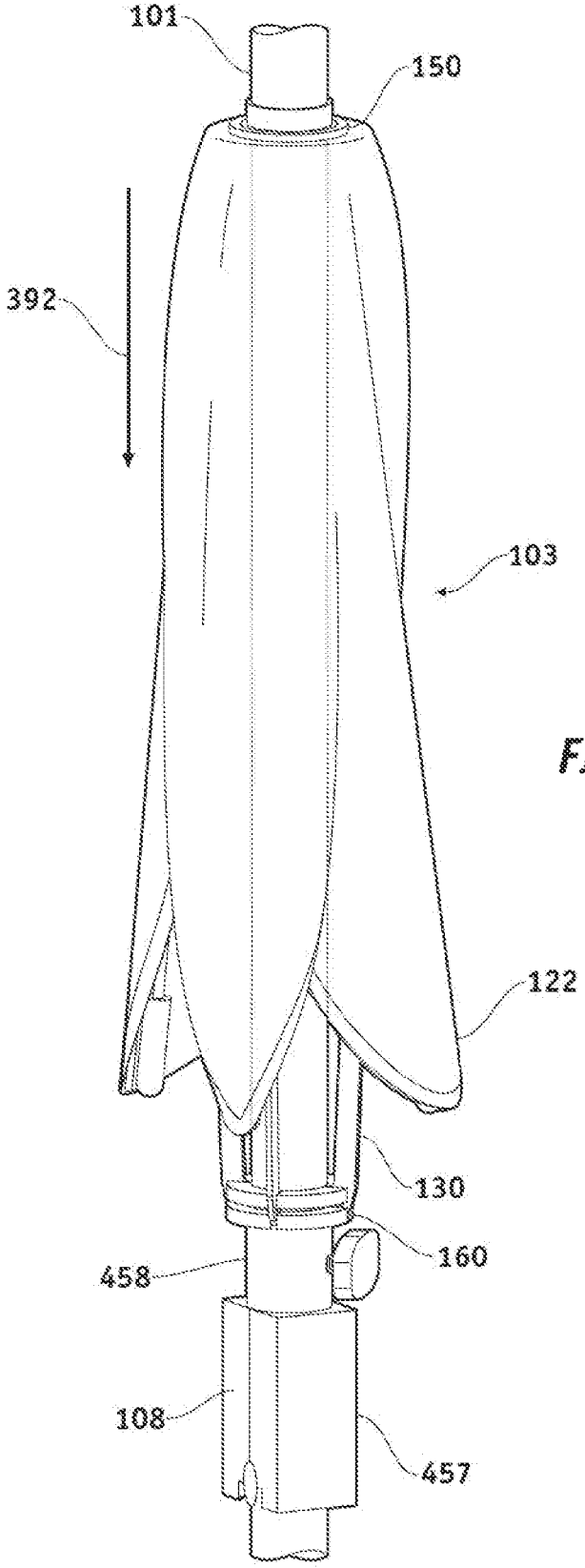
FIG. 3 is a close-up view of the collapsible table shown in FIG. 2 in the collapsed position with the bottom hub in contact with the hub stop.

Referring to FIGS. 1-2, either or both the top hub 150 and the bottom hub 160 are slidable along the central post 109. This allows the collapsible table 122 to expand and collapse between the expanded position shown in FIG. 1 and the collapsed position shown in FIG. 2. To expand the collapsible table 122 into the expanded position, the top hub 150 and the bottom hub 160 must be moved toward each other. In some embodiments, this movement is accomplished by sliding both the top hub 150 and the bottom hub 160 in a first direction along the central post 109 toward the hub stop 108. In embodiments where the hub stop 108 is below the bottom hub 160, the first direction may be downward, as indicated by arrow 392 in FIGS. 3 and 4. In other embodiments, where the hub stop 108 is above the top hub 150, the first direction may be upward, as indicated by arrow 492 in FIG. 5. The collapsible table 122 may then be expanded by forcing one of the top hub 150 and the bottom hub 160 against the hub stop 108 while continuing to slide the other of the top hub 150 and the bottom hub 160 in the first direction along the central post 109. This allows the top hub 150 to move with respect to the bottom hub 160 from a position distal to the bottom hub 160 to a position adjacent to the bottom hub 160, expanding the collapsible table 122 into the expanded position.

Figure 9:
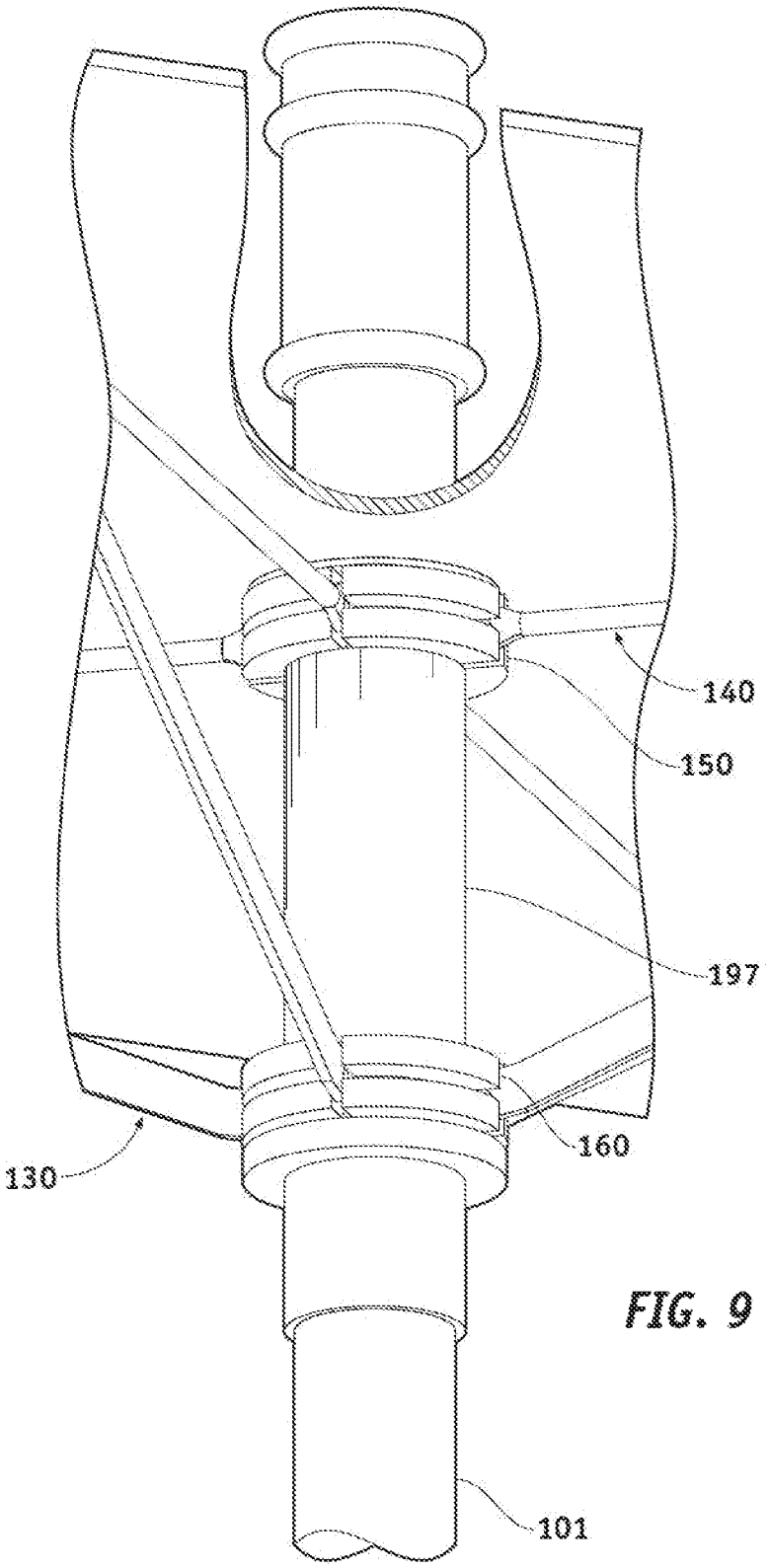
FIG. 9 is a close-up view of the top hub and the bottom hub of the support post when the collapsible table is in the expanded position.

The support post 101 may have an interior hub stop 197 located on the central post 109 between the top hub 150 and the bottom hub 160 to provide appropriate spacing between the top hub 150 and the bottom hub 160 when the collapsible table 122 is in the expanded position (see FIGS. 1 and 9). The interior hub stop 197 may be permanently affixed or releasably secured to the support post 101. In addition, the interior hub stop 197 may be an integrated portion of either the top hub 150 or the bottom hub 160, or may be an independent sleeve positioned between the top hub 150 and the bottom hub 160. As either one or both of the top hub 150 and/or the bottom hub 160 is slid along the support post 101 to move into the expanded position, the interior hub stop 197 operates as a barrier stop to either hub to actuate the table to the expanded position and/or prevent over-actuation of the table surface support frame 120. Those skilled in the art will appreciate that the interior hub stop 197 is strategically positioned along the support post 101 to aide in maintaining the expanded position of table surface support frame 120 so that the collapsible surface 122 forms a substantially planar surface for use as a useable table surface.

Figure 6:
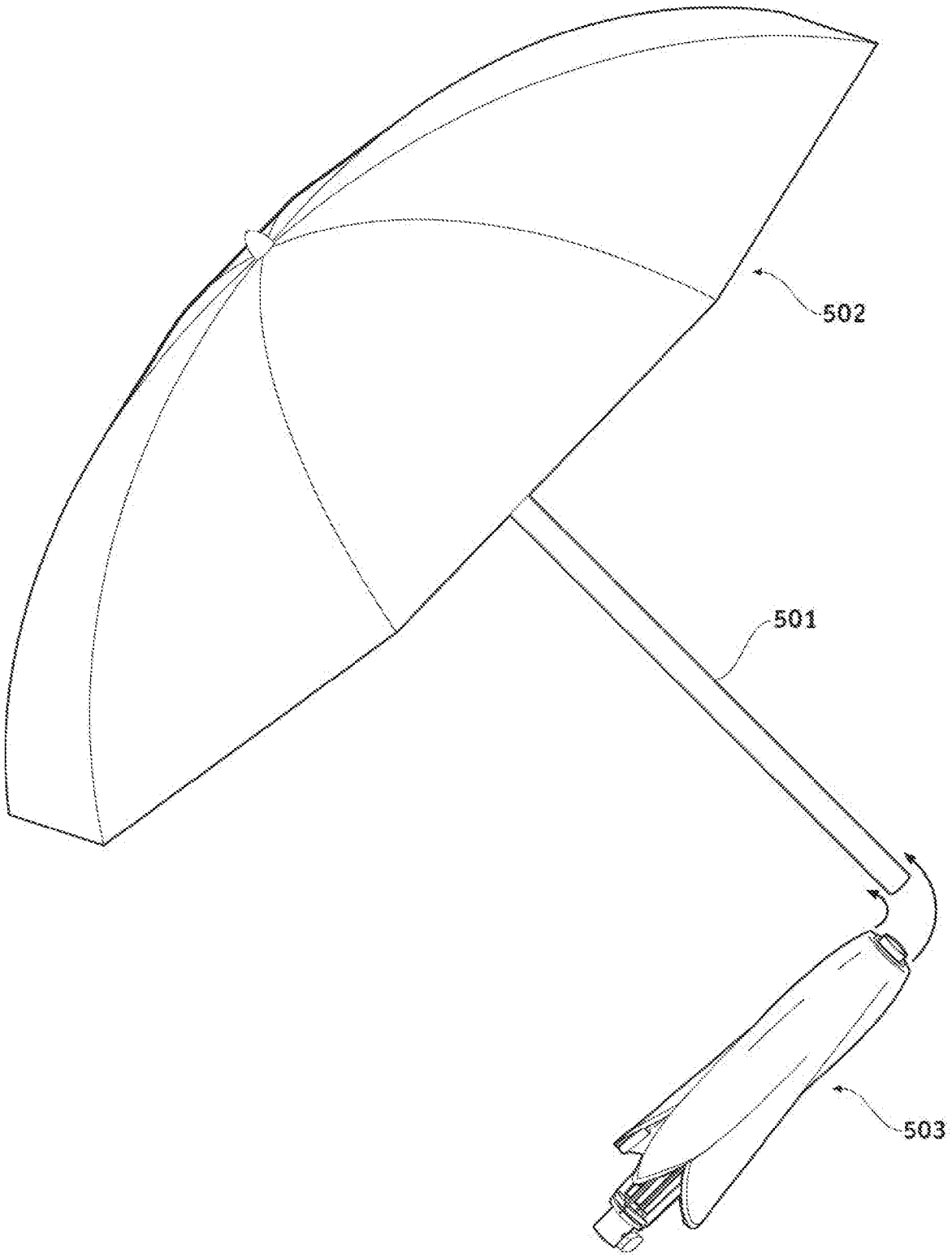
FIG. 6 is an exploded view of the support post shown in FIG. 1 with the central post removed.
Figure 7:
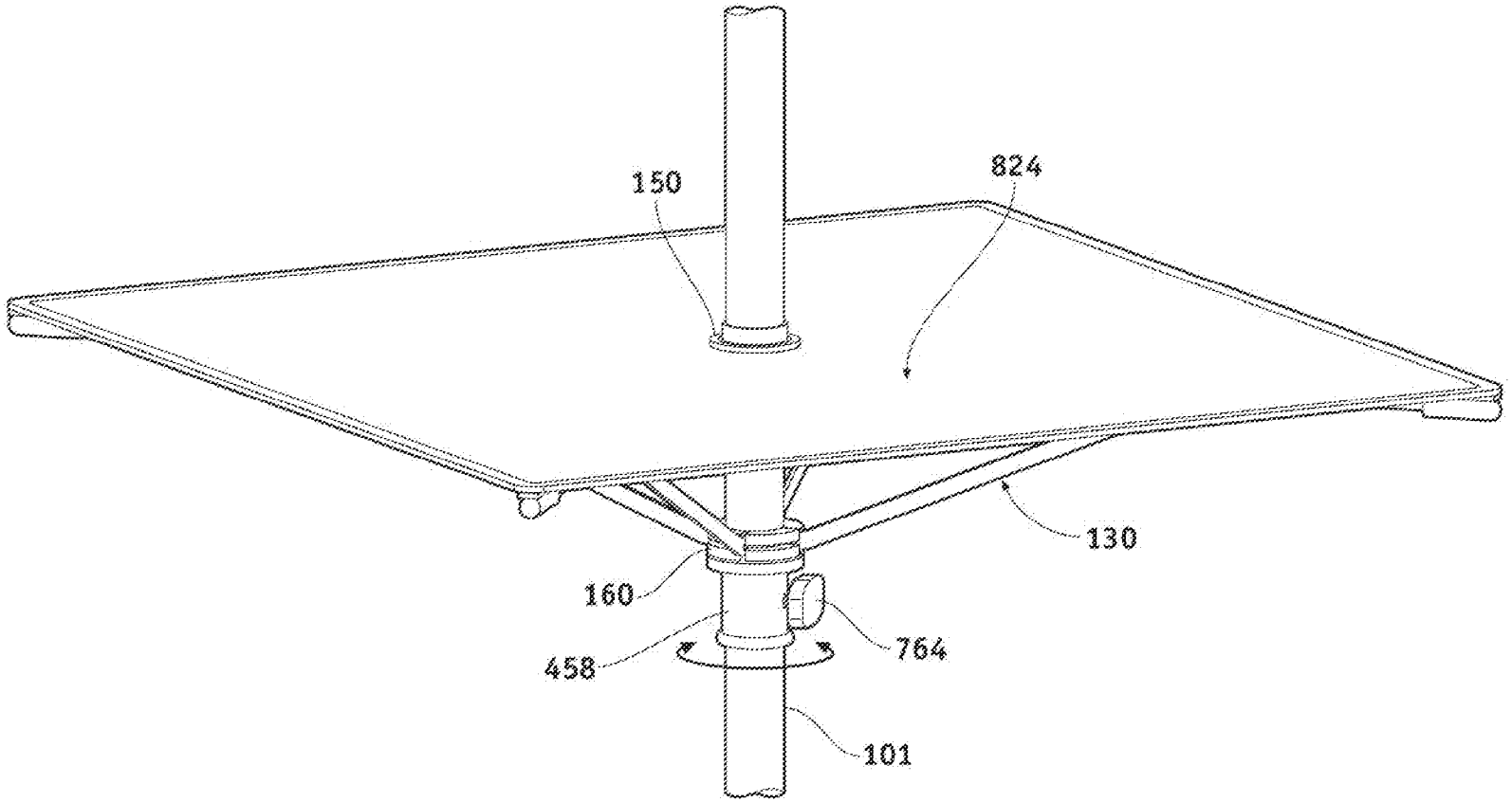
FIG. 7 is a close-up view of the collapsible table shown in FIG. 1 in the expanded position.
Figure 8:
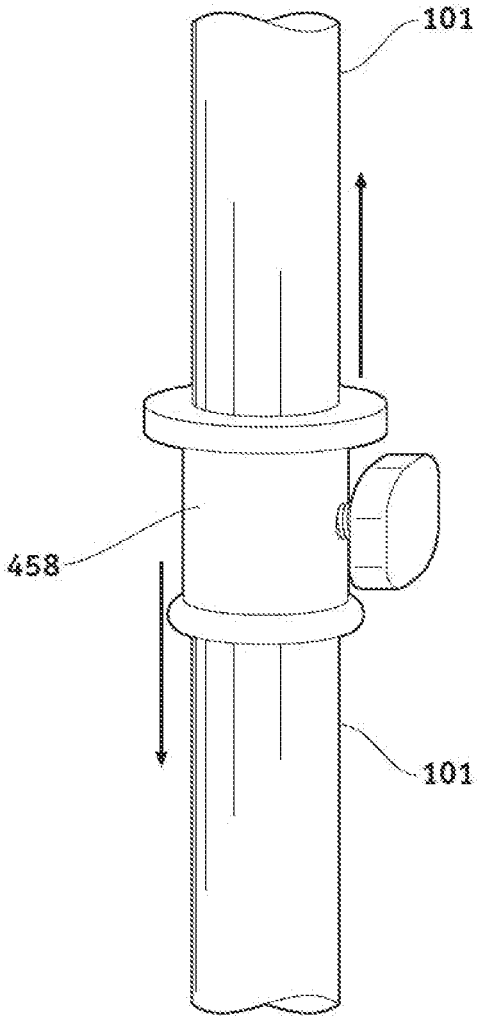
FIG. 8 is a close-up view of the adjustable stop in an embodiment of the support post where the adjustable stop is movable along the central post independent of the bottom hub.

The support post 101 may also have an adjustable stop 458 slidably coupled to the central post 109 below the bottom hub 160. The adjustable stop 458 is configured to lock onto the central post 109 at any of a plurality of selectable heights. Additionally, the adjustable stop 458 defines a minimum height for the bottom hub 160. The height of the collapsible table 122 above the ground or other surface is adjustable based on the height of the adjustable stop 458. To adjust the height of the adjustable stop 458, the adjustable stop 458 may be slid along the central post 109 to a first height of the plurality of selectable heights. The adjustable stop 458 may then be affixed to the central post 109 at the first height. The adjustable stop 458 is adjustable independent of whether the collapsible table 122 is in the collapsed position or in the expanded position. In some embodiments, the adjustable stop 458 is fixedly coupled to the bottom hub 160, as shown in FIGS. 1-6. In other embodiments, the adjustable stop 458 is movable along the central post 109 independent of the bottom hub 160, as shown in FIGS. 7-8. In such an embodiment, the bottom hub 160 may rest on top of the adjustable stop 458. Thus, the height of the collapsible table 122 may be fixed and the collapsible table 122 may be rotatable while in the expanded position or in the collapsed position.

The adjustable stop 458 may be affixed to the central post 109 in any manner known in the art. In particular embodiments, as shown in FIGS. 7 and 8, the adjustable stop 458 may have a threaded bolt 764 configured to tighten into the adjustable stop 458 and grip the central post 109 at any height of the plurality of selectable heights. Thus, the minimum height for the bottom hub 160 may be adjusted when the collapsible table 122 is in the expanded position and when the collapsible table 122 is in the collapsed position by releasing the adjustable stop 458, sliding the adjustable stop 458 along the central post 109 to a second height of the plurality of selectable heights, and affixing the adjustable stop 458 at the second height. In some embodiments, the adjustable stop 458 may also function as a hub stop by first fixing the adjustable stop 458 in place and then forcing the bottom hub 160 against the adjustable stop 458 while sliding the top hub 150 toward the adjustable stop 458. For the purposes of this disclosure, forcing one of the top hub 150 and the bottom hub 160 against the adjustable stop 458 to expand the collapsible table into the expanded position is considered an equivalent of forcing one of the top hub 150 and the bottom hub 160 against the hub stop 108.

In particular embodiments, the adjustable stop 458 may be positioned between the top hub 150 and the bottom hub 160 and provides a support function to the table system 103, acting as either or both of a barrier stop to prevent over-actuation of the table by either of the top hub 150 and the bottom hub 160 sliding along the central post 109, or to act as a hub stop against which the top hub 150 or bottom hub 160 may be forced against to expand the table.

In some embodiments, the top hub 150, the bottom hub 160, the adjustable stop 458, and/or the hub stop 108 may be releasably securable to the support post 101 by at least one of; a compression clamp, a screw clamp, a friction clamp, a thumb screw, a pin lock, or other like releasably securing mechanisms now known in the art or developed in the future.

With return reference to FIG. 1, in some embodiments, the table surface support frame 120 comprises a plurality of arms 130 having a plurality of table arms 135 and a complimentary plurality of support arms 140. It will be appreciated by those skilled in the art that the term "complimentary" indicates that, in some embodiments, for each of the plurality of table arms 135 there is a corresponding support arm 140 associated with it. It will be further appreciated by those skilled in the art that while the exemplary embodiments disclosed herein describe table arms 135 and support arms 140 suitably coupled together to form the table surface support frame 120, other configurations comprising additional or fewer arms are contemplated by this disclosure.

Those skilled in the art will further appreciate that while this disclosure describes primarily an integrated table 103 in conjunction with a beach umbrella, the integrated table 103 may be employed by any umbrella system, including, for example, residential or commercial patio-style type umbrellas. Moreover, the integrated table 103 is not limited to be incorporated solely with various umbrella systems, but rather may be employed by any support structure comprising a support post 101 that the collapsible/expandable table system 103 may couple to, including, for example, stand-alone tables without umbrella canopies, portable canopy structures, fence posts, and any other support structure.

For example, in some embodiments, the table system 103 may exist independently from a completely integrated system 100. As shown by FIG. 6, a table system 503, like table system 103 described herein, may be a separate system that is not integrated with a support post 101. For example, the table system 503 may be procured independently and subsequently appended to an umbrella system and post, such as umbrella system 502 and post 501.

Referring back to FIG. 1, each of the plurality of table arms 135 comprises a hub end 137 that is hingedly coupled to the top hub 150 and a table end 139 opposite the hub end 137 that is coupled to a perimeter portion of the collapsible table 122. When the collapsible table 122 is in the expanded position, each table end 139 of the plurality of table arms 135 may be at the same height from the bottom end 185 of the support post 101 as the top hub 150. Each of the plurality of support arms 140 comprises a hub end 142 that is hingedly coupled to the bottom hub 160 and a support end 144 opposite the hub end 142 that is hingedly coupled to a corresponding table arm 135 of the plurality of table arms 135.

With continued reference to FIGS. 1 and 2, the support post 101 may comprise a tubular element made from aluminum to provide a lightweight yet strong central support for the system 100. However, any other material, such as wood, metals, alloys, plastics, composites, and the like may be employed to operate as the support post 101. To provide for the compactness and portability of the system 100, i.e. for travel and/or storage, the support post 101 may comprise various sectional portions that may be disassembled and subsequently reassembled. As depicted in FIG. 1, the support post 101 may separate into the upper post 107 and the central post 109, wherein the upper post 107 supports the umbrella system 102, and the central post 109 supports the table system 103. In some embodiments, the upper post 107 and the central post 109 may couple together to form the entirety of the support post 101. The various sectional components may secure together to form the assembled support post 101 by any securing/release mechanism, for example, frictional fits, pins, nested telescoping sections, and the like. Among other embodiments, and to further facilitate the compact nature of the system 100 for travel and/or storage, the support post 101 may alternatively comprise a collapsible, telescopic, or foldable configuration. Moreover, any other mechanism and/or method now known or developed in the future that can operate as a support post in a similar manner as the support post 101 and configured to be compact for storage and/or travel, may be used.

The table system 103 may have various characteristics. For example, the table system 103 may be rotatable about the support post 101. In addition, as explained above, the adjustable stop 458 may function as a hub stop, as shown in FIG. 7. The bottom hub 160 may abut against the adjustable stop 458, and table system 103 may be actuatable into the expanded position in a similarly described fashion as above with respect to the table system 103 and the hub stop 108. The bottom hub 160 may include a releasable securing device to alternatively secure or rotate the position of the table surface 824 to facilitate access by users on different sides of the table to rotate the table to access items placed on the table. As illustrated best in FIGS. 7 and 8, the adjustable stop 458 may be entirely separate from the top hub 150 and bottom hub 160 so that it moves and secures to the support post 101 entirely separate from the table system 103.

Figure 10:
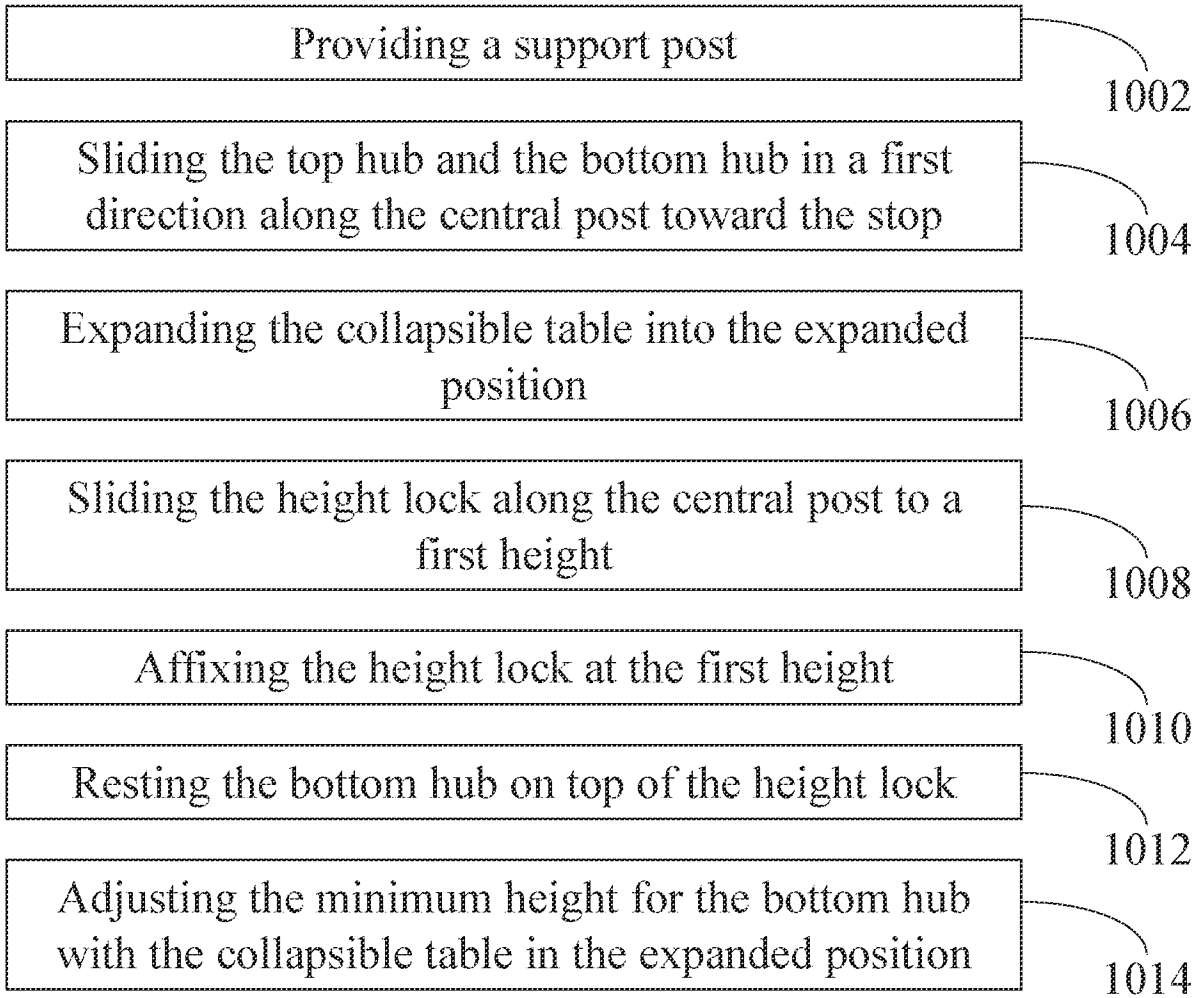
FIG. 10 is a process diagram illustrating the components of a method of deploying the collapsible table.
Figure 11:
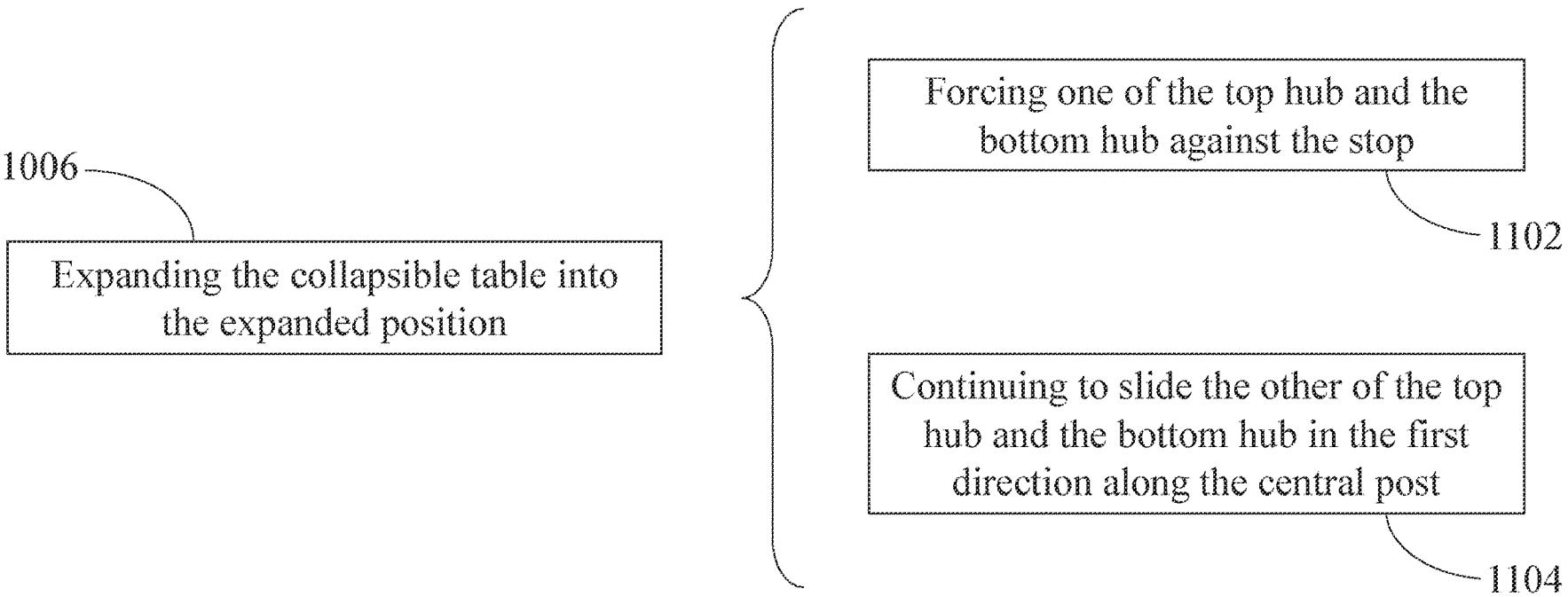
FIG. 11 is a process diagram illustrating the components of expanding the collapsible table in the expanded position.
Figure 12:
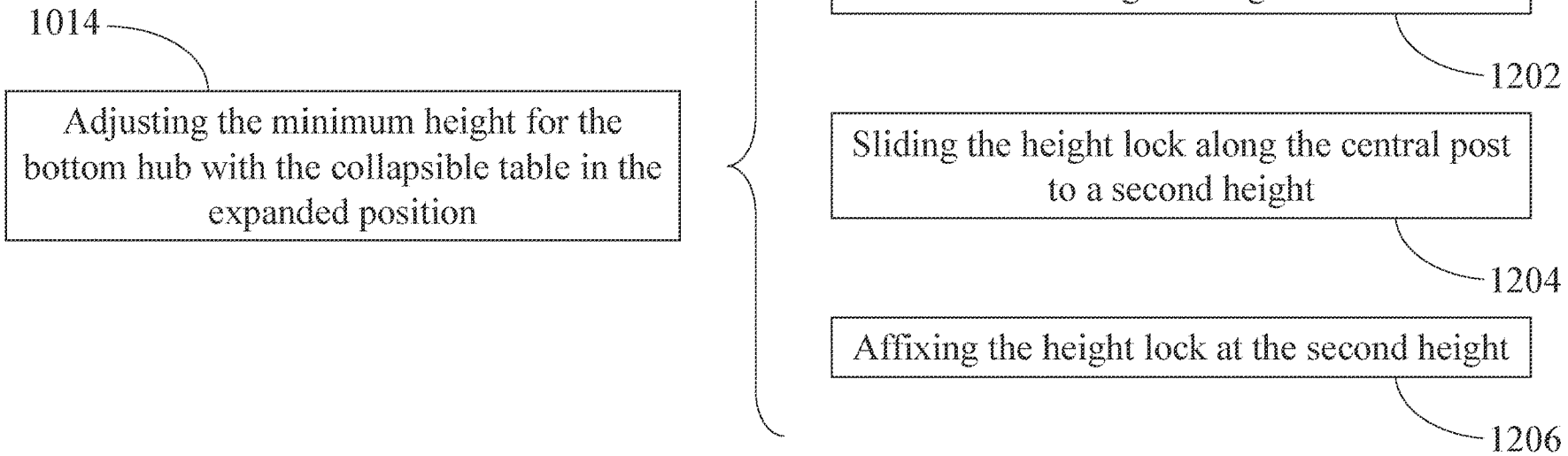
FIG. 12 is a process diagram illustrating the components of adjusting the minimum height for the bottom hub.

Turning to FIGS. 10-12, a method for deploying the collapsible table 122 may comprise providing a support post 1002, sliding the top hub and the bottom hub in a first direction along the central post toward the stop 1004, expanding the collapsible table into the expanded position 1006, sliding the adjustable stop along the central post to a first height 1008, affixing the adjustable stop at the first height 1010, resting the bottom hub on top of the adjustable stop 1012, and adjusting the minimum height for the bottom hub with the collapsible table in the expanded position 1014. Expanding the collapsible table into the expanded position 1006 may comprise forcing one of the top hub and the bottom hub against the stop 1102 and continuing to slide the other of the top hub and the bottom hub in the first direction along the central post 1104. Adjusting the minimum height for the bottom hub 1014 may comprise releasing the adjustable stop 1202, sliding the adjustable stop along the central post to a second height 1204, and affixing the adjustable stop at the second height 1206.

In the foregoing description, integrated beach umbrella systems and table systems have been described with reference to specific exemplary embodiments. Various modifications and changes may be made, however, without departing from the scope of the integrated beach umbrella systems and table system as set forth herein. The detailed description and figures are illustrative, rather than restrictive, and modifications are intended to be included within the scope of the various exemplary embodiments. Accordingly, the scope of the exemplary embodiments should be determined by the claims and their legal equivalents, rather than by merely the examples described.

For example, the steps recited in any method or process claims may be executed in any order and are not limited to the specific order presented in the claims. Additionally, the components and/or elements recited in any article, system, apparatus and/or device claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required, or essential features or components of any or all the claims.

As used herein, the terms "comprise", "comprises", "comprising", "having", "including", "includes" "is" or any variation thereof, are intended to reference a non-exclusive inclusion, such that a process, method, article, system, device, composition or apparatus that comprises a list of elements does not include only those elements recited, but may also include other elements not expressly listed or inherent to such process, method, article, system, device, composition or apparatus. Other combinations and/or modifications of the above-described structures, arrangements, applications, proportions, elements, materials or components used in the practice of integrated beach umbrella and table systems, in addition to those not specifically recited, may be varied or otherwise particularly adapted to specific environments, manufacturing specifications, design parameters or other operating requirements without departing from the general principles of the same.

As used herein, the terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of integrated beach umbrella and table systems and their methods of manufacture described herein are, for example, capable of operation in sequences other than those illustrated or otherwise described herein.

The terms "left," "right," "top," "bottom," "front," "back," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of integrated beach umbrella systems and table systems and their methods of manufacture described herein are, for example, capable of operation in other orientations than those illustrated or otherwise described herein. The term "coupled," as used herein, is defined as directly or indirectly connected in a physical, mechanical, electrical, magnetic, or other manner.

It will be understood that implementations of a support post are not limited to the specific assemblies, devices and components disclosed in this document, as virtually any assemblies, devices and components consistent with the intended operation of a support post may be used. Accordingly, for example, although particular support posts, and other assemblies, devices and components are disclosed, such may include any shape, size, style, type, model, version, class, measurement, concentration, material, weight, quantity, and/or the like consistent with the intended operation of support posts. Implementations are not limited to uses of any specific assemblies, devices and components; provided that the assemblies, devices and components selected are consistent with the intended operation of a support post.

Accordingly, the components defining any support post may be formed of any of many different types of materials or combinations thereof that can readily be formed into shaped objects provided that the materials selected are consistent with the intended operation of a support post. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various support posts may be manufactured using conventional procedures as added to and improved upon through the procedures described here. Some components defining a support post may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling support posts are not limited to the specific order of steps as disclosed in this document. Any steps or sequence of steps of the assembly of a support post indicated herein are given as examples of possible steps or sequence of steps and not as limitations, since various assembly processes and sequences of steps may be used to assemble support posts.

The implementations of a support post described are by way of example or explanation and not by way of limitation. Rather, any description relating to the foregoing is for the exemplary purposes of this disclosure, and implementations may also be used with similar results for a variety of other applications employing a support post.

What is claimed is:

1. A method of deploying a collapsible table, comprising:

providing a support post with a collapsible table in a collapsed position, the support post having:

a central post;

a hub stop fixedly coupled to the central post;

a top hub slidably coupled to the central post;

a plurality of table arms hingedly coupled to the top hub;

a bottom hub slidably coupled to the central post below the top hub;

a plurality of support arms each with a hub end and a support end opposite the hub end, wherein each hub end is hingedly coupled to the bottom hub and each support end is hingedly coupled to a corresponding table arm of the plurality of table arms; and an adjustable stop slidably coupled to the central post below the bottom hub, the adjustable stop configured to lock onto the central post at any of a plurality of selectable heights and define a minimum height for the bottom hub;

wherein the top hub moves with respect to the bottom hub when the collapsible table expands from the collapsed position in which the top hub is distal to the bottom hub to an expanded position in which the top hub is adjacent to the bottom hub;

sliding both the top hub and the bottom hub in a first direction along the central post toward the hub stop;

expanding the collapsible table into the expanded position by forcing one of the top hub and the bottom hub against the hub stop while continuing to slide the other of the top hub and the bottom hub in the first direction along the central post;

sliding the adjustable stop along the central post to a first height of the plurality of selectable heights; and affixing the adjustable stop at the first height.

2. The method of claim 1, wherein the adjustable stop is fixedly coupled to the bottom hub.

3. The method of claim 1, wherein the adjustable stop is movable along the central post independent of the bottom hub.

4. The method of claim 3, further comprising resting the bottom hub on top of the adjustable stop.

5. The method of claim 1, further comprising adjusting the minimum height for the bottom hub with the collapsible table in the expanded position by releasing the adjustable stop, sliding the adjustable stop along the central post to a second height of the plurality of selectable heights, and affixing the adjustable stop at the second height.

6. A method of deploying a collapsible table, comprising:
providing a support post with the collapsible table in a collapsed position, the support post having:
a central post;
a hub stop fixedly coupled to the central post;
a top hub slidably coupled to the central post;
a plurality of table arms hingedly coupled to the top hub;
a bottom hub slidably coupled to the central post below the top hub; and
a plurality of support arms each with a hub end and a support end opposite the hub end, wherein each hub end is hingedly coupled to the bottom hub and each support end is hingedly coupled to a corresponding table arm of the plurality of table arms;
wherein the top hub moves with respect to the bottom hub when the collapsible table expands from the collapsed position in which the top hub is distal to the bottom hub to an expanded position in which the top hub is adjacent to the bottom hub;
sliding both the top hub and the bottom hub in a first direction along the central post toward the hub stop;
expanding the collapsible table into the expanded position by forcing one of the top hub and the bottom hub against the hub stop while continuing to slide the other of the top hub and the bottom hub in the first direction along the central post; and
with the collapsible table in the expanded position, sliding the bottom hub along the central post to a first height of a plurality of selectable heights.

7. The method of claim 6, the support post further having an adjustable stop slidably coupled to the central post below the bottom hub, the adjustable stop configured to lock onto the central post at any of the plurality of selectable heights and define a minimum height for the bottom hub.

8. The method of claim 7, further comprising sliding the adjustable stop along the central post to the first height and affixing the adjustable stop at the first height.

9. The method of claim 7, wherein the adjustable stop is fixedly coupled to the bottom hub.

10. The method of claim 7, wherein the adjustable stop is movable along the central post independent of the bottom hub.

11. The method of claim 10, further comprising resting the bottom hub on top of the adjustable stop.

12. The method of claim 7, further comprising adjusting the minimum height for the bottom hub with the collapsible table in the expanded position by releasing the adjustable stop, sliding the adjustable stop along the central post to a second height of the plurality of selectable heights, and affixing the adjustable stop at the second height.

13. A method of deploying a collapsible table, comprising:
providing a support post with the collapsible table in a collapsed position, the support post having:
a central post;
a hub stop fixedly coupled to the central post a top hub slidably coupled to the central post;
a plurality of table arms each hingedly coupled to the top hub;
a bottom hub slidably coupled to the central post below the top hub; and
a plurality of support arms each hingedly coupled to the bottom hub and hingedly coupled to a corresponding table arm of the plurality of table arms;
wherein the top hub moves with respect to the bottom hub when the collapsible table expands from the collapsed position in which the top hub is distal to the bottom hub to an expanded position in which the top hub is adjacent to the bottom hub;
expanding the collapsible table into the expanded position by forcing one of the top hub and the bottom hub against the hub stop while sliding the other of the top hub and the bottom hub along the central post; and
with the collapsible table in the expanded position, sliding the bottom hub along the central post to a first height of a plurality of selectable heights.

14. The method of claim 13, further comprising sliding both the top hub and the bottom hub in a first direction along the central post with the collapsible table in the collapsed position.

15. The method of claim 13, the support post further having an adjustable stop slidably coupled to the central post below the bottom hub, the adjustable stop configured to lock onto the central post at any of the plurality of selectable heights and define a minimum height for the bottom hub.

16. The method of claim 15, further comprising sliding the adjustable stop along the central post to the first height and affixing the adjustable stop at the first height.

17. The method of claim 15, wherein the adjustable stop is fixedly coupled to the bottom hub.

18. The method of claim 15, wherein the adjustable stop is movable along the central post independent of the bottom hub.

19. The method of claim 18, further comprising resting the bottom hub on top of the adjustable stop.

20. The method of claim 15, further comprising adjusting the minimum height for the bottom hub by releasing the adjustable stop, sliding the adjustable stop along the central post to a second height of the plurality of selectable heights, and affixing the adjustable stop at the second height.

* * * * *